US005940036A

United States Patent [19]

Oliver et al.

[11] Patent Number: 5,940,036

[45] **Date of Patent: *Aug. 17, 1999**

[54] BROADBAND CIRCULARLY POLARIZED DIELECTRIC RESONATOR ANTENNA

[75] Inventors: Matthew Bjorn Oliver, Medley; Yahia Mohamed Moustafa Antar, Kingston; Rajesh Kumar Mongia, Kitchener; Apisak Ittipiboon, Kanata, all of Canada

[73] Assignee: Her Majesty the Queen in right of Canada, as represented by the Minister of Industry through the Communications Resarch Centre, Ottawa, Canada

[ * ] Notice: This patent issued on a continued prosecution application filed under 37 CFR 1.53(d), and is subject to the twenty year patent term provisions of 35 U.S.C. 154(a)(2).

[21] Appl. No.: 08/666,216

[22] Filed: Jun. 20, 1996

Related U.S. Application Data

[60] Provisional application No. 60/002,250, Jul. 13, 1995.

[51] Int. Cl.[6] ..... H01Q 1/38

[52] U.S. Cl. ..... 343/700 MS; 343/829; 333/219.1

[58] Field of Search ..... 343/700 MS, 909, 343/767, 829, 846, 848, 849, 770; 333/219.1, 212; H01Q 1/38

[56] References Cited

U.S. PATENT DOCUMENTS

| | | | |
|---|---|---|---|
| 4,540,955 | 9/1985 | Fiedziuszko | 323/212 |
| 4,843,400 | 6/1989 | Tsao et al. | 343/700 |
| 5,517,203 | 5/1996 | Fiedziuszko | 333/219.1 |

FOREIGN PATENT DOCUMENTS

| | | | |
|---|---|---|---|
| 0277203 | 12/1986 | Japan | 333/219.1 |
| 0165204 | 6/1989 | Japan | 333/219.1 |

OTHER PUBLICATIONS

"A Circularly Polarized Dielectric Guide Antenna with a Single Slot Feed". Ittipiboon; Roscoe, Mongia, Cuhaci. 1994 Anthem Conf. Proc., pp. 427–430.

"Circularly Polarized Dielectric Resonator Antenna", Mongia, Ittipiboon, Cuhaci, Roscoe. Electronics Letters, May 18,1994, vol. 30, No. 17, pp. 1361–1362.

"Low profile dielectric resonator antennas using a very high permittivity material". Mongia, Ittipiboon, Cuhaci. Electronics Letters, Aug. 18,1994, vol. 30, No. 17, pp. 1362–1363.

"Circularly polarised rectangular dielectric resonator antenna". Oliver, Antar, Mongia, Ittipiboon. Electronics Letters, Mar. 16,1995, vol. 31 No. 6, pp. 418–419.

"Aperture fed rectangular and triangular dielectric resonators for use as magnetic dipole antennas". Ittipiboon; Mongia; Antar; Bhartia; Cuhaci. Electronics Letters, Nov. 11,1993, vol. 29, No. 23, pp. 2001–2002.

"Broadband circularly polarized planar array composed of a pair of dielectric resonator antennas". Haneisha, Takaawa. Electronics Letters, May 9,1985, vol. 21, No. 10, pp. 437–438.

*Primary Examiner*—Don Wong
*Assistant Examiner*—Tho Phan
*Attorney, Agent, or Firm*—Neil Teitelbaum & Associates

[57] ABSTRACT

A radiating antenna capable of generating or receiving circularly polarized radiation is disclosed using a single feed and a dielectric resonator. The dielectric resonator has slightly differing dimensions along two axes. Substantially polarized radiation can be generated in each of two mutually orthogonal modes by placement of the probe at each of two locations. When the feed is situated substantially between these two locations, two orthogonal modes are excited simultaneously.

19 Claims, 4 Drawing Sheets

BROADBAND CIRCULARLY POLARIZED DIELECTRIC RESONATOR ANTENNA

This application claims priority from U.S. provisional application No. 60/002,250 filed on Jul. 13, 1995.

FIELD OF THE INVENTION

This invention relates to dielectric resonator antennas for use with circularly polarized radiation and more specifically to such an antenna with a single feed.

BACKGROUND OF THE INVENTION

The increase in use of satellites in communication and navigation systems requires small antennas for vehicular (car, boat or aircraft) applications. These small antennas must be able to receive circularly polarized radiation even from low elevation angles.

An antenna element in common use today is the microstrip patch antenna which inherently has a very limited frequency bandwidth. This antenna has numerous advantages such as simple fabrication, conformal planar structure, and the existence of many well proven design methodologies and tools. Satellite communications antennas have been built using microstrip patch antennas having metallic radiating elements and producing circularly polarized radiation. In U.S. Pat. No. 4,843,400 a microstrip patch antenna is disclosed which produces circularly polarized radiation using a single feed. The antenna is based on a symmetrical patch with differing dimensions along the axes; however, as many of the existing methodologies and tools have been designed for microwave bands, use of millimeter wave bands requires new antenna design methodologies.

At higher frequencies, metal radiating elements, such as those present in microstrip patch antennas, develop large ohmic losses in conducting surfaces and their effects become significant, also dielectric substrate materials become increasingly dispersive. Designs can not simply be scaled from lower frequencies to higher frequencies without accounting for these factors. Other traditional approaches include the use of multiple monopoles with a reflector and helical antennas both of which have been found to lack robustness and to be difficult to fabricate.

Unshielded dielectric resonators are known to radiate strongly at and around some of their resonant frequencies. Dielectric resonators possess inherent advantages such as high radiation efficiency due to no conductor loss, small size and mechanical simplicity. The radiation pattern, resonant frequency and the operating frequency bandwidth of a dielectric resonator antenna depend on the excited resonant mode, permittivity, the resonator geometry and its surroundings. These provide many degrees of design freedom which may be exploited in controlling antenna characteristics.

Rectangular dielectric resonator antennas have been excited in "magnetic dipole" mode and shown to produce a linearly polarized electric field. To achieve this, a rectangular dielectric resonator antenna is placed on a metallic plane over a small aperture which is excited by a microstripline on the other side of a dielectric substrate. This can also be done using a single probe or monopole antenna placed near the centre of one side of the resonator. The rectangular resonator, and its image in the ground plane combine to form an isolated horizontal magnetic dipole.

If a single element is to be implemented in arrays, the simpler the single-element feed, the simpler the array feed. The limiting case would be a single-feed antenna. It is desirable to minimize the complexity of an antenna feed network so that losses and physical size are lessened. Producing circularly polarized radiation requires two fields mutually orthogonal in both space and time having equal amplitude. Thus, to modify an inherently linearly polarized antenna element (such as the dielectric resonator) such that it is circularly polarized, requires the excitation of two mutually orthogonal modes within the antenna element. This can easily be done with dual feed points, or with an array of properly designed linearly polarized antenna elements. It has now been found that the generation of circularly polarized radiation using a single feed and a single dielectric resonator can be accomplished.

OBJECT OF THE INVENTION

It is an object of this invention to provide a single feed dielectric resonator antenna for use with circularly polarized radiation.

SUMMARY OF THE INVENTION

In accordance with an embodiment of the invention there is provided a radiating antenna comprising:

a) a dielectric resonator antenna having a bottom surface and outer surfaces and designed to be capable of being excited in two orthogonal modes simultaneously;

b) a single feed means capable of exciting two orthogonal modes simultaneously; whereby the feed means and the dielectric resonator operate in conjunction to simultaneously excite two mutually orthogonal modes in the dielectric resonator.

In accordance with an embodiment of the invention there is further provided a radiating antenna comprising:

a) a single feed means further comprising
   i) a dielectric substrate having a conductive coating on an anterior side thereof and with an opening having unequal dimensions along two perpendicular axes coplanar with the dielectric substrate, and
   ii) a microstripline on a posterior side of the dielectric substrate disposed to cross the opening along the centre and parallel to the shorter of the unequal axes; and c) a dielectric resonator having a bottom surface, outer surfaces, and a length and width disposed on the conductive coating over the slot and further disposed such that an axis of the dielectric resonator is at an angle of substantially 45 degrees to the axes of the slot.

BRIEF DESCRIPTION OF THE DRAWINGS

Exemplary embodiments of the invention will now be described in conjunction with the following figures in which.

DETAILED DESCRIPTION OF THE INVENTION

Figure 1:
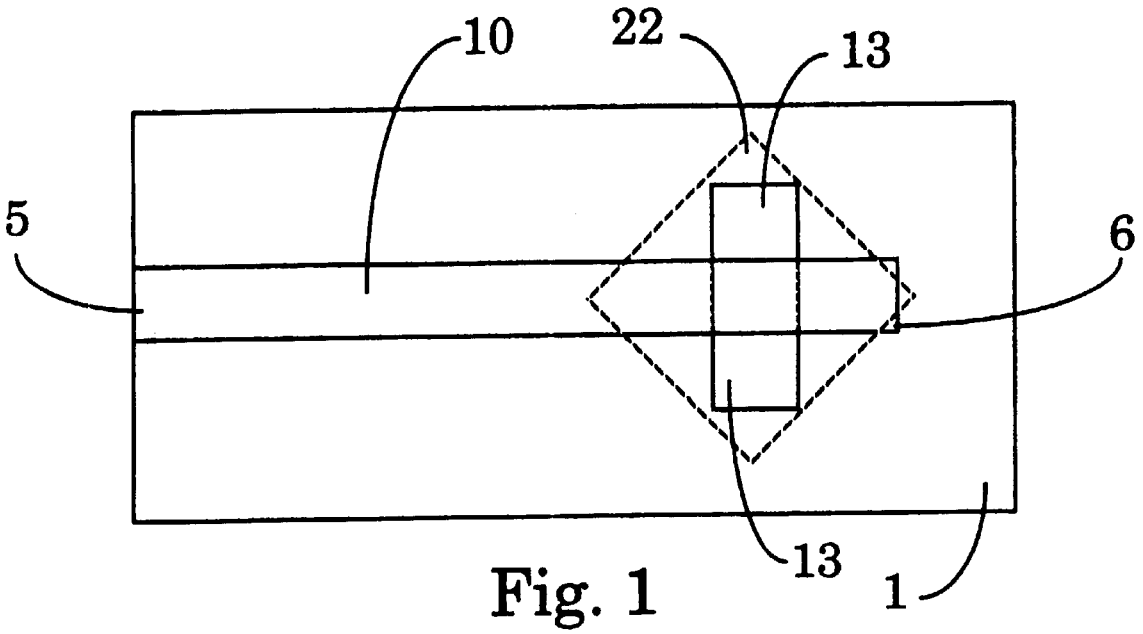
FIG. 1 is a bottom view (not to scale) of a dielectric resonator antenna element according to this invention with elements on the top side shown with dashed lines.
Figure 2:
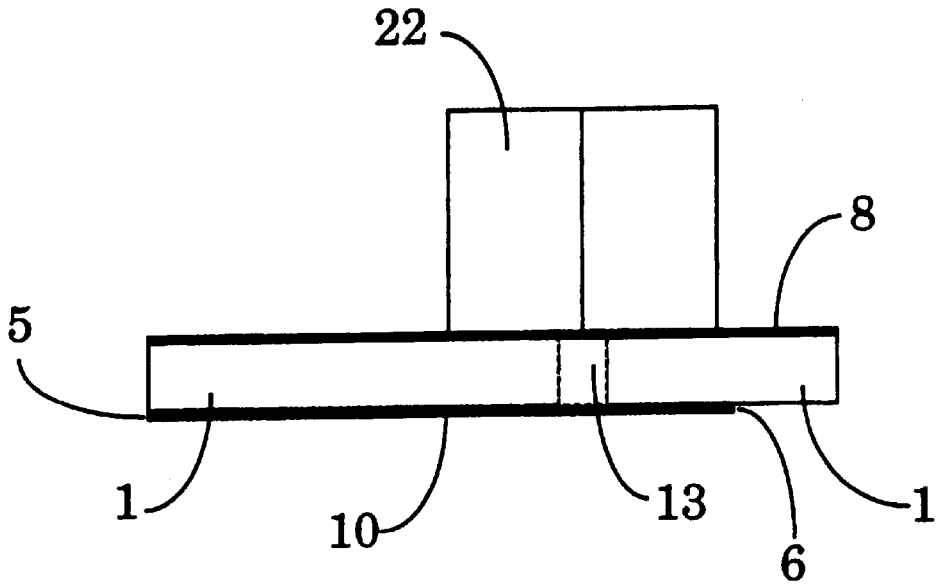
FIG. 2 is a profile view (not to scale) of a dielectric resonator antenna element according to this invention wherein a microstripline and a slot form feed means.

Referring to FIG. 1 and FIG. 2, an antenna is shown comprising a large substantially flat dielectric substrate 1. A top side of the dielectric substrate 1 is coated with a conductive film 8 and above this is located a dielectric resonator 22 shown in dashed line. Through the conductive film 8 and the substantially flat dielectric substrate 1, a feed means in the form of a transverse narrow slot 13 having a long axis and a short axis, in the form of a rectangle, is formed. The slot may, for example, be formed by conventional etching. A microstripline 10, shown in solid line in FIG. 1, is formed on a bottom side of the substantially flat dielectric substrate 1. The microstripline 10 extends from an input/output 5 disposed at an end thereof, passing under the centre of the long axis of the narrow slot 13 and terminating a fixed distance after the narrow slot 13. The microstripline may be moved away from the centre of the long axis of the narrow slot 13 in order to tune the antenna. Optionally, to the input/output 5 of the microstripline 10 is attached a proper connector (not shown) to feed energy to the microstripline 10 for transmitting operation of the antenna or to receive energy from the microstripline 10 for receiving operation of the antenna. The connector type is determined by the requirements of each application. Alternatively, the microstripline 10 is continued to a further connection; for example, the microstripline may connect several antenna elements and have a common connector for use in an antenna array.

The dielectric resonator 22 has three perpendicular axes which meet at an origin and which reflect width, length and height of the dielectric resonator 22. For rectangular solids, each edge is parallel to an axis. For other shapes, the axes are to be defined according to the particular shape or determined experimentally. In experimentally determining the axes of a particular solid for use according to this invention, the dielectric should be excited in a linearly polarized fashion using a single feed. The direction of polarization is a first axis and the excitation point lies on this axis. For use with the present invention, another axis must exist orthogonal to the first axis. Exciting different points along an outside edge of the solid and following a path from the excitation point to the another axis, will result in different balances between the two orthogonal fields.

The substantially flat dielectric substrate 1 has a thickness which is small compared to the operating frequency of the antenna. When the antenna is used to transmit, power is fed into the input/output 5 of the microstripline 10. The power propagates along the microstripline 10, and the fields associated with the power couple through the narrow slot 13 exciting fields within the dielectric resonator 22. The dimensions of the narrow slot 13 and its displacement with respect to the microstripline end 6 are optimized so that nearly all of the incident energy is coupled to the dielectric resonator 22 at its resonant frequency. The dimensions of the narrow slot 13 are chosen to ensure that its lowest order resonating frequency is much higher than the resonant frequency of the dielectric resonator 22.

The dielectric resonator 22 is placed over the narrow slot 13 so that the length axis of the dielectric resonator 22 is at an angle of substantially 45 degrees with respect to the long dimension of the narrow slot 13. The angle may be varied slightly in tuning the antenna to change the performance characteristics of the antenna. The dielectric resonator antenna 22 is attached to the conductive film 8. For example, the dielectric resonator 22 can be glued to the conductive film 8 with an epoxy or a silicone compound. This positioning causes two mutually orthogonal "magnetic dipole" modes of the dielectric resonator 22 to be excited simultaneously. The directions are parallel with the conductive film 8 and are aligned with the length and width axes of the bottom side of the dielectric resonator 22.

An antenna was tested wherein a rectangular non-resonant slot with a slot width of <lambda>/20, where lambda represents the guided wavelength within the dielectric, was etched in a substrate 0.0635 cm thick having a dielectric constant of 2.32. The operating frequency range was 4 to 6 GHz. The microstripline feed extended approximately <lambda>/4 past the slot. The dielectric resonator was substantially cubic with the dimensions chosen such that $$f_1/Q_1+f_2/Q_2=f_2-f_1$$

where $f_1$ and $f_2$ denote resonance frequencies and $Q_1$ and $Q_2$ denote unloaded radiation Q-factors of the two modes. Further, the dielectric resonator 22 was glued at an angle of about 45 degrees relative to the axes of the slot with silicone cement. The resulting rectangular dielectric resonator had a dielectric constant of 40 and dimensions of 5.8 mm by 6.4 mm by 6.4 mm and the antenna operated between 5.2 GHz and 5.5 GHz. The radiation emitted by such an antenna is circularly polarized.

Figure 3:
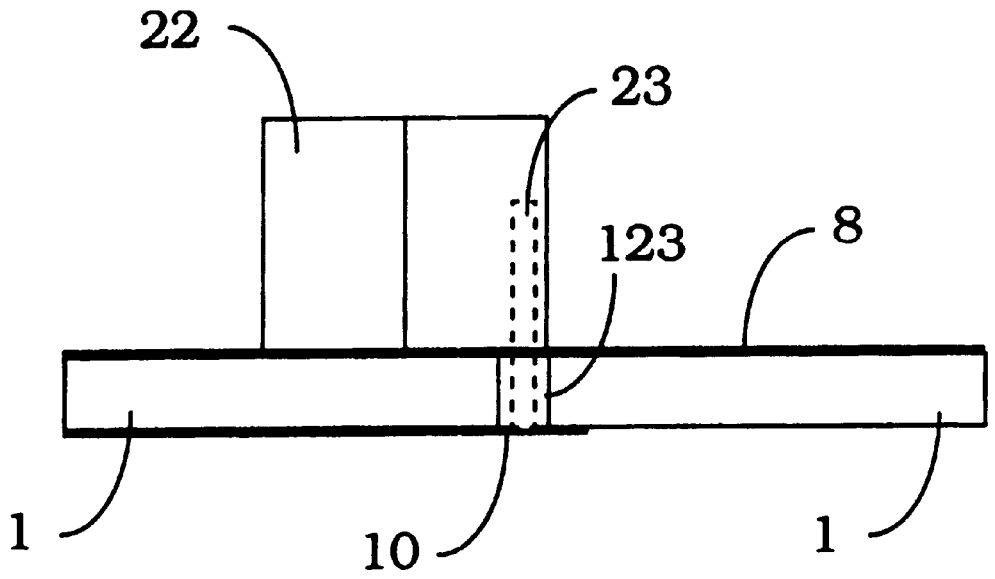
FIG. 3 is a profile view (not to scale) of a probe fed antenna element according to this invention wherein a feed probe inserted into a dielectric resonator forms feed means.
Figure 4:
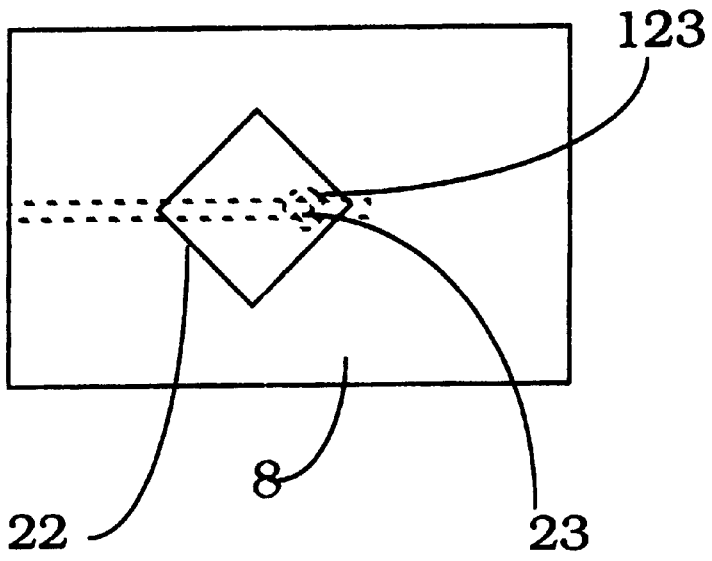
FIG. 4 is a top view (not to scale) of a further dielectric resonator antenna element according to this invention wherein a feed probe inserted into a dielectric resonator forms feed means.

Referring to FIG. 3 and FIG. 4, an alternative embodiment is shown wherein the dielectric resonator 22 is suitably drilled and an end of the feed means in the form of a probe 23 inserted into the interior of the resonator through one of the diagonals. The probe 23 is isolated from the metal film 8 by a spacing means 123. Typically, the probe is a coaxial cable provided with a centre conductive element acting as the probe and an outer conductive shield in contact with the metal film or ground plane. The shield and the centre conductive element are separated by a spacing means 123. Alternatively, another suitable probe 23 and spacing means 123 may be used. This preserves many of the benefits of using probe technologies and those of microstripline technologies. In FIG. 4, the spacing means 123 and the probe 23 are shown in dashed lines to indicate their presence below the dielectric resonator 22. Positioning of the probe 23 such or in contact with an outer edge on or near a corner thereof excites two mutually orthogonal "magnetic dipoles" of the dielectric resonator 22 simultaneously. The two "magnetic dipoles" are parallel with the ground plane and are aligned with the length and width axes of the dielectric resonator's bottom side.

Figure 5:
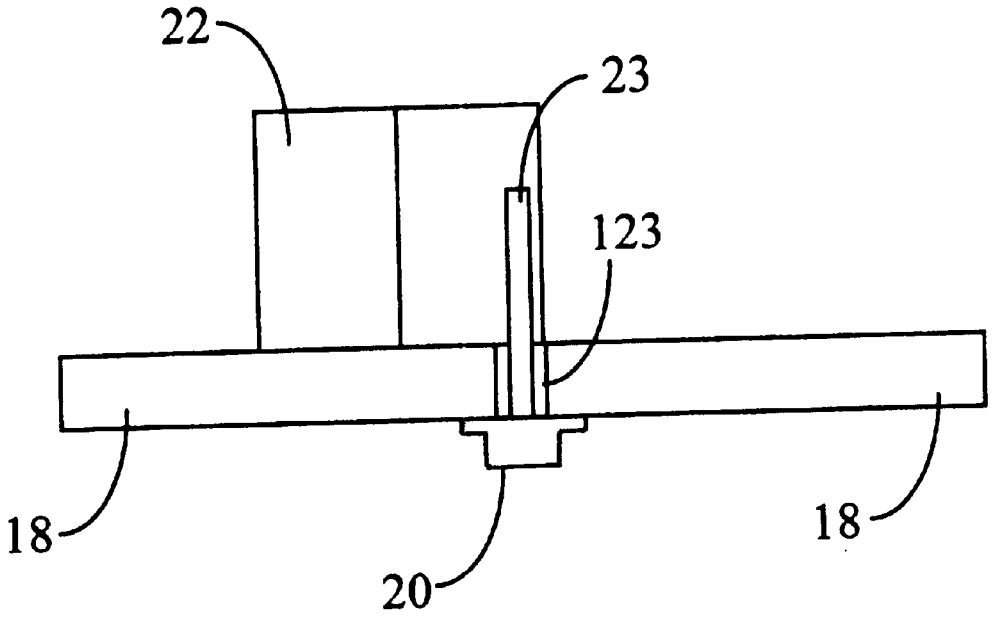
FIG. 5 is a profile view (not to scale) of a probe fed antenna element according to this invention wherein a probe in contact with an outside edge of a dielectric resonator forms feed means.
Figure 6:
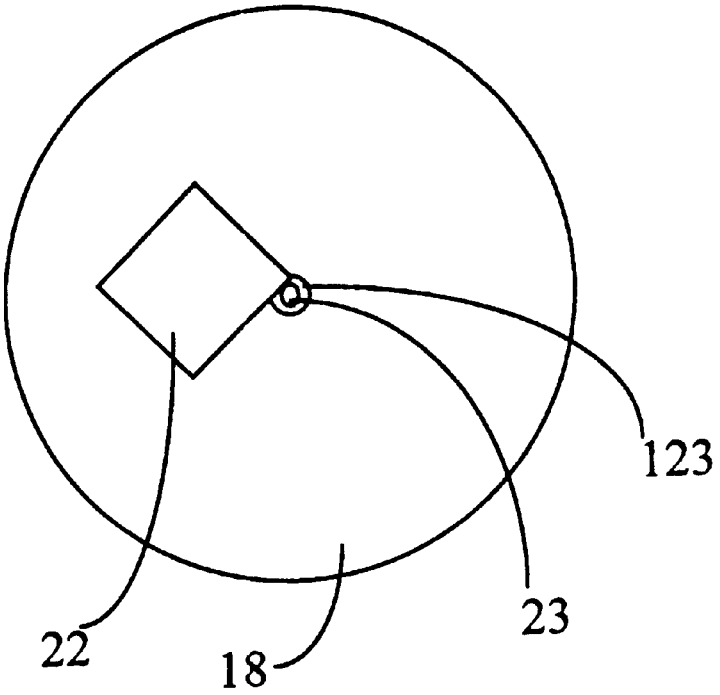
FIG. 6 is a top view (not to scale) of a probe fed antenna element according to this invention wherein a probe in contact with an outside edge of a dielectric resonator forms feed means.

An alternative embodiment of the invention, shown in FIG. 5 and FIG. 6, comprises a substantially flat conducting ground plane 18 provided with an opening designed to receive a feed means. Through this opening a feed means in the form of a suitably sized conductive probe 23 is placed. The dielectric resonator 22 is affixed to the substantially flat conducting ground plane 18, for example with an epoxy or silicone compound, such that it is in contact with the probe 23 at or near a corner 19 of the dielectric resonator 22.

The probe dimensions are chosen such that a good impedance match is had between the feed line and the dielectric antenna element 22, but also so that the probe 23 is not resonant at the frequency of the antenna operation. The probe 23 terminates in a suitable connector 20 in the form of a coax connector on the opposing side of the ground plane 18. The connector 20, for example, may be used to connect a suitable feed line from a radio-frequency source. The ground plane 18 is thick enough to ensure that skin depth at the frequency of operation is exceeded and the dimensions of the ground plane 18 are chosen to ensure desirable antenna radiation performance.

In operation, the probe 23 is provided with a signal to be transmitted or provides the received signal through the connector 20 disposed on the bottom side of the conducting ground plane 18. The probe 23 is spaced from the conducting ground plane 18 by a spacing means 123 of non-conductive material.

Referring to FIG. 6, the dielectric resonator antenna 22 is shown relative to the probe 23. The spacing means 123 disposed between the probe 23 and the conductive ground plane 18 is made of non-conductive material. The probe 23 is placed at or near a corner of the dielectric resonator antenna 22, in the form of a substantially cubic solid, such that both modes are excited simultaneously. The optimal location is determined experimentally.

Figure 7:
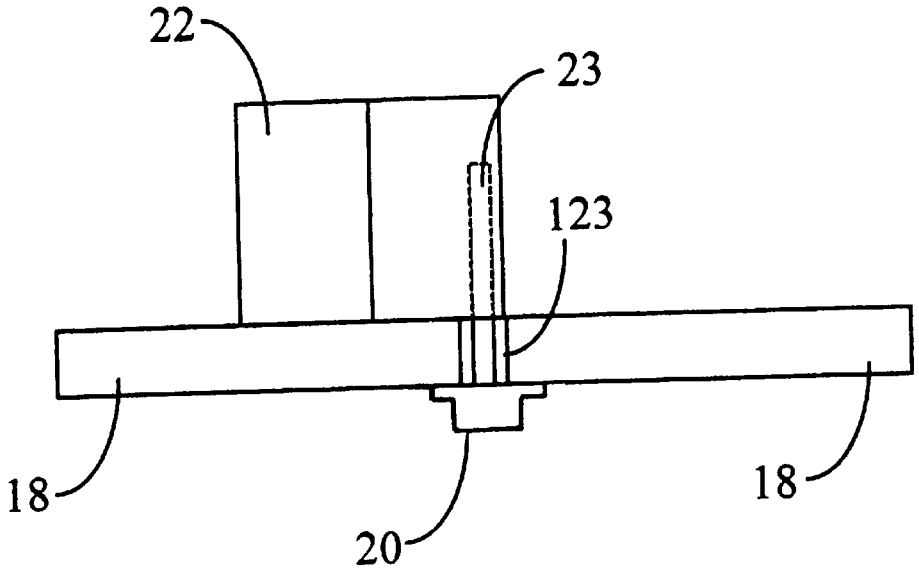
FIG. 7 is a profile view (not to scale) of a further probe fed antenna element according to this invention wherein a probe inserted into a dielectric resonator forms feed means.
Figure 8:
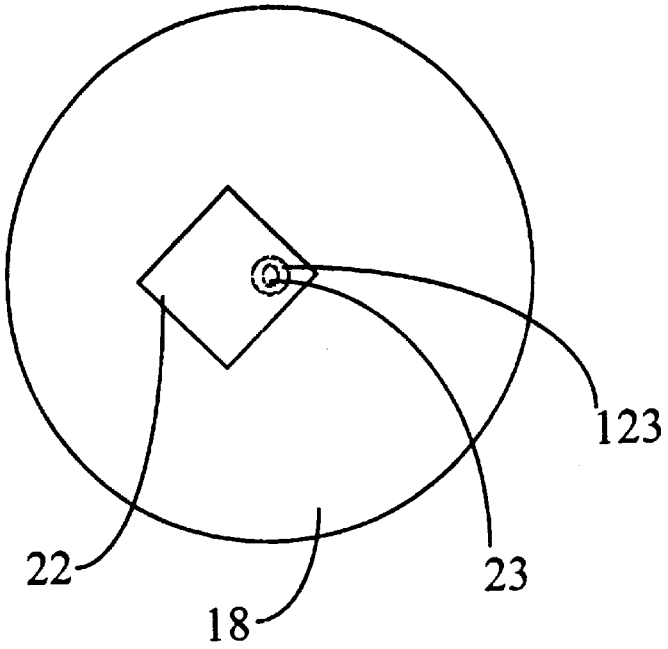
FIG. 8 is a top view (not to scale) of a further probe fed antenna element according to this invention wherein a probe inserted into a dielectric resonator forms feed means.

Alternatively, as shown in FIG. 7 and FIG. 8, the dielectric resonator 22 may be suitably drilled and an end of the probe 23 inserted into the interior of the resonator on a diagonal. The probe 23 and the spacing means 123 are shown in solid to indicate the presence of the dielectric resonator 22 to the foreground. This positioning of the probe 23 excites two mutually orthogonal "magnetic dipoles" of the dielectric resonator 22 simultaneously. The two "magnetic dipoles" are parallel with the ground plane and are aligned with the length and width axes of the dielectric resonator's bottom side.

The radiation Q-factor of an open dielectric resonator depends primarily on the dimensions and the permittivity of the resonator and decreases with a decrease in permittivity. Since the impedance bandwidth of an antenna is inversely proportional to the radiation Q-factor, a relatively large frequency bandwidth can be obtained by selecting a low value of dielectric constant for the resonator material. Thus, the configuration offers advantages in terms of a relatively large operating bandwidth over which the antenna radiates efficiently; however, if the application requires a lower impedance bandwidth, this can be achieved by selecting a higher dielectric constant. This would also further reduce the size of the antenna, since the wavelength, within the dielectric (guided wavelength) is shorter than the equivalent free-space wavelength.

A dielectric resonator antenna, such as those shown in FIG. 3, FIG. 5 and FIG. 6, using an edge feed of a dielectric resonator 22 with almost equal length and width dimensions generates circular polarization when the ratio of dimensions is properly chosen. Circular polarization occurs because the different dimensions allow two spatially orthogonal modes with slightly different resonant frequencies to coexist. When the proper frequency spacing is chosen between the modes, they exist in phase quadrature. This inter-mode relation can also be obtained through the use of inductive or capacitive discontinuities such as slots or through any arbitrary shape which combines dissimilar length and width dimensions such as a rectangle or an ellipse. A similar result is obtained through the use of feed means, as shown in FIG. 1, FIG. 2, FIG. 4, FIG. 7 and FIG. 8, which penetrate the dielectric resonator 22 at a point on or near a diagonal between the long and short axes. Such a point should optimally be chosen on a diagonal and then moved experimentally when further tuning is necessary.

Using a suitable feed means, the length and width dimensions of the axes of the dielectric resonator in the form of a rectangular solid are chosen close to <lambda>, where lambda represents the guided wavelength within the dielectric. The specific relation between the two dimensions is determined based on operating frequency, shape, length, width and height of the dielectric resonator, and relative dielectric permittivity of the resonator. The use of resonators with electrical or physical discontinuities (such as partial metallization on an exterior surface or a slot cut into one face) is also possible; the design criteria for resonators with discontinuities are known. The metallization or the slot has a resonating frequency that is much higher than the resonant frequency of a dielectric resonator. The function of the strip or the slot is to perturb the field in order to generate the required inter-mode relation for circular polarization generation. The feed means location for such a resonator is determined based on the requirement of exciting two orthogonal modes (with similar amplitudes) to produce circularly polarized radiation.

The feed means herein described and used to excite the antenna were selected to enhance antenna integration. The feed means to be used is arbitrarily chosen such that it excites two modes in equal amplitude. For example, an open-ended waveguide, slotted waveguides, an antenna or a cavity antenna can be used as the feed means. The probe means herein described is described in contact with the radiating element, it has been found that the antenna according to this invention also operates when a small air gap exists between the probe and the dielectric resonator. Further, this antenna could be used as the feed element for a reflector system which would redirect and shape the radiation.

Dimensions of length and width of the dielectric resonator are chosen to have resonant frequencies that are close but not equal. When the ratio of length and width dimensions is optimal, these modes will exhibit orthogonal phase with respect to each other. The phase orthogonality and the spatial orthogonality created by physical structure of the dielectric resonator produce a circularly polarized electric field. The structure may be in the form of a solid having slightly different length and width dimensions, a solid having gaps such that phase orthogonality will result, or any other geometry capable of forming the desired phase orthogonality with a single feed. The feed means herein described is capable of exciting two modes with the use of a single physical feed.

As this invention contains no non-reciprocal devices, its operation is identical in both a receiving antenna and transmitting antenna.

Numerous other embodiments may be envisaged without departing from the spirit and scope of the invention.

What we claim is:

1. A radiating antenna comprising:

a) a dielectric resonator antenna having a bottom surface and outer surfaces and designed to be capable of being excited in two orthogonal modes simultaneously;

b) a single feed disposed off center the dielectric resonator and capable of exciting two orthogonal modes simultaneously;

whereby the single feed and the dielectric resonator operate in conjunction to simultaneously excite two mutually orthogonal modes in the dielectric resonator for omitting circularly polarised radiation.

2. The radiating antenna of claim 1 wherein the outer surfaces of the dielectric resonator are non-metallic.

3. The radiating antenna of claim 1 further comprising a ground plane.

4. The radiating antenna of claim 3 wherein the bottom surface is in contact with the ground plane.

5. The radiating antenna of claim 1 wherein the bottom surface is substantially flat.

6. The radiating antenna of claim 1 wherein the dielectric resonator is a solid having a substantially flat bottom surface and wherein width and length are unequal.

7. The radiating antenna of claim 6 wherein the width and length differ by a small predetermined amount.

8. The radiating antenna of claim 1 wherein the dielectric resonator antenna is capable of being excited in each of two substantially linear orthogonal modes by a feed at each of two predetermined locations on the at least an outer surface;

and the single feed is disposed at another location substantially between the at least two locations and capable of exciting two orthogonal modes simultaneously.

9. A radiating antenna comprising:

a) a single feed comprising i) a dielectric substrate having a conductive coating on an anterior side thereof and with an opening having unequal dimensions along two perpendicular axes coplanar with the dielectric substrate, one of the perpendicular axes being the major axis of the opening, and ii) a microstripline on a posterior side of the dielectric substrate disposed to cross the opening along the centre and parallel to the shorter of the unequal major axes; and c) a dielectric resonator having a bottom surface, outer surfaces, and a length and width disposed on the conductive coating over the opening and further disposed such that a major axis of the dielectric resonator is at an angle of substantially 45 degrees to the major axes of the opening.

10. The radiating antenna of claim 9 wherein the outer surfaces of the dielectric resonator are non-metallic.

11. The radiating antenna of claim 9 wherein the width and length differ by small predetermined amount.

12. The radiating antenna of claim 9 wherein the dielectric resonator is capable of being excited in each of two orthogonal modes by a feed at each of two predetermined locations on the at least an outer surface and wherein the single feed further comprises a probe extending from the microstripline to the dielectric resonator and terminating at another location between the at least two predetermined locations and capable of exciting two orthogonal modes simultaneously whereby the feed operates to simultaneously excite two mutually orthogonal modes in the dielectric resonator.

13. The radiating antenna of claim 12 wherein the probe is in contact with the dielectric resonator.

14. A radiating antenna comprising:

a) a conductive ground plane provided with an opening;

b) a dielectric resonator having a substantially flat bottom surface having a width and length, outer surfaces, and at least an edge adjacent its bottom surface and two axes coplanar with its bottom surface and said dielectric resonator being capable of being excited in two orthogonal substantially linear modes by a feed in each of at least two locations; and c) a single feed comprising a probe protruding through the opening in the ground plane and spaced therefrom by a non-conductive spacing means said probe having an end proximate the dielectric resonator at another location between the at least two locations whereby the feed operates to excite two mutually orthogonal modes within the dielectric resonator simultaneously.

15. The radiating antenna of claim 14 wherein said end of the probe extends adjacent an edge of the bottom surface of the dielectric resonator.

16. The radiating antenna of claim 15 wherein the probe is in contact with the-dielectric resonator.

17. The radiating antenna of claim 14 wherein the dielectric resonator is a solid having a substantially flat bottom surface prodded with an opening and provided with unequal width and length and wherein said end of the probe extends into the opening in the bottom surface of the dielectric resonator.

18. The radiating antenna of claim 17 wherein the width and length differ by small predetermined amount.

19. The radiating antenna of claim 17 wherein the probe is in contact with the dielectric resonator.

* * * * *

UNITED STATES PATENT AND TRADEMARK OFFICE

CERTIFICATE OF CORRECTION

PATENT NO. : 5,940,036

DATED : August 17, 1999

INVENTOR(S) : Oliver et al.

It is certified that error appears in the above-identified patent and that said Letters Patent is hereby corrected as shown below:

Claim 1: In the last line of the claim, please replace the word "omitting" with --emitting--

Signed and Sealed this

Fourth Day of January, 2000

*Attest:*

*Attesting Officer*

*Acting Commissioner of Patents and Trademarks*